US010518552B2

(12) United States Patent
Murayama et al.

(10) Patent No.: US 10,518,552 B2
(45) Date of Patent: Dec. 31, 2019

(54) METHOD OF DISCHARGING FLUID FROM LIQUID EJECTING APPARATUS

(71) Applicant: SEIKO EPSON CORPORATION, Tokyo (JP)

(72) Inventors: Masato Murayama, Matsumoto (JP); Takeshi Yoshida, Shiojiri (JP); Kaoru Koike, Matsumoto (JP); Ryoji Fujimori, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/540,332

(22) Filed: Aug. 14, 2019

(65) Prior Publication Data

US 2019/0366732 A1 Dec. 5, 2019

Related U.S. Application Data

(62) Division of application No. 15/719,226, filed on Sep. 28, 2017.

(30) Foreign Application Priority Data

Oct. 4, 2016 (JP) ..... 2016-196542

(51) Int. Cl.
*B41J 2/185* (2006.01)
*B05B 15/40* (2018.01)
(Continued)

(52) U.S. Cl.
CPC ..... *B41J 2/185* (2013.01); *B05B 9/0403* (2013.01); *B05B 12/087* (2013.01); *B05B 15/40* (2018.02);
(Continued)

(58) Field of Classification Search
CPC .... B41J 2/185; B41J 2/17563; B41J 2/17596; B05B 15/40; B05B 9/0403; B05B 12/087
See application file for complete search history.

(56) References Cited

U.S. PATENT DOCUMENTS

2009/0109267 A1* 4/2009 Lee ..... B41J 2/175 347/89
2010/0079513 A1 4/2010 Taira et al.
(Continued)

FOREIGN PATENT DOCUMENTS

JP H05-1163337 5/1993
JP 2005-053075 3/2005
(Continued)

*Primary Examiner* — Lamson D Nguyen
(74) *Attorney, Agent, or Firm* — Workman Nydegger

(57) ABSTRACT

A liquid ejecting apparatus includes a liquid ejecting section from which liquid is ejected. A return passage has a first end connected to a supply passage at a first location and a second end connected to the supply passage at a second location. The second location is positioned closer to the liquid ejecting section than the first location. The return passage and the supply passage constitute a circulating passage. A pump can cause fluid to flow through the circulating passage. A replaceable filter unit is a portion of the return passage. A discharge passage through which the fluid is discharged to the outside is connected to the return passage. An inflow controller can suppress external fluid from entering the discharge passage.

7 Claims, 4 Drawing Sheets

(51) Int. Cl.

| | |
|---|---|
| ***B41J 2/175*** | (2006.01) |
| ***B05B 12/08*** | (2006.01) |
| ***B05B 9/04*** | (2006.01) |

(52) U.S. Cl.
CPC ..... *B41J 2/17563* (2013.01); *B41J 2/17596* (2013.01)

(56) References Cited

U.S. PATENT DOCUMENTS

| | | | | |
|---|---|---|---|---|
| 2010/0103208 | A1 | 4/2010 | Asami et al. | |
| 2015/0224786 | A1 | 8/2015 | Otsuka et al. | |
| 2018/0093491 | A1* | 4/2018 | Murayama ..... | B05B 15/40 |

FOREIGN PATENT DOCUMENTS

| | | |
|---|---|---|
| JP | 2009-241385 | 10/2009 |
| JP | 4455138 | 4/2010 |
| JP | 2010-076301 | 8/2010 |
| JP | 2010-228147 | 10/2010 |
| JP | 2011-062858 | 3/2011 |
| JP | 2012-183730 | 9/2012 |
| JP | 2015-147365 | 8/2015 |
| JP | 2016-068314 | 5/2016 |

* cited by examiner

METHOD OF DISCHARGING FLUID FROM LIQUID EJECTING APPARATUS

BACKGROUND

1. Technical Field

The present invention relates to a liquid ejecting apparatus and a method of discharging fluid from a liquid ejecting apparatus.

2. Related Art

Ink jet printers are one example of liquid ejecting apparatuses. JP-A-2011-62858 discloses an exemplary ink jet printer in which a filter is provided in an ink supply passage.

In an ink jet printer as described above, if foreign matter, such as solids or bubbles, is accumulated in a filter provided in a liquid supply passage, a pressure loss in the liquid supply passage may increase, thus prohibiting a sufficient amount of liquid from being supplied through this passage. This disadvantage may occur in not only printers that eject inks to print an image but also most of other liquid ejecting apparatuses in which liquid to be ejected is supplied through a passage.

SUMMARY

An advantage of some aspects of the invention is that a liquid ejecting apparatus and a method of discharging fluid from a liquid ejecting apparatus which enable liquid to be appropriately supplied to a liquid ejecting section through a passage in which a filter is provided.

A liquid ejecting apparatus according to an aspect of the invention includes: a liquid ejecting section from which liquid is ejected; and a supply passage through which the liquid is supplied from a liquid supply source to the liquid ejecting section. A return passage has a first end connected to the supply passage at a first location and a second end connected to the supply passage at a second location. The second location is positioned closer to the liquid ejecting section than the first location. The return passage and the supply passage constitute a circulating passage. A pump can cause fluid to flow through the circulating passage. A filter unit has a filter that captures foreign matter. The filter unit is replaceable and is a portion of the return passage. A discharge passage through which the fluid is discharged to an outside of the liquid ejecting apparatus is connected to the return passage. An inflow controller can suppress external fluid from entering the discharge passage.

BRIEF DESCRIPTION OF THE DRAWINGS

The invention will be described with reference to the accompanying drawings, wherein like numbers reference like elements.

DESCRIPTION OF EXEMPLARY EMBODIMENTS

A description will be given below of a liquid ejecting apparatus and a method of discharging fluid from a liquid ejecting apparatus according to an embodiment of the invention, with reference to the accompanying drawings. In this embodiment, for example, the liquid ejecting apparatus may be an ink jet printer that records or prints an image on a medium by discharging liquids onto the medium; the medium may be a paper sheet; and the liquids may be inks.

Figure 1:
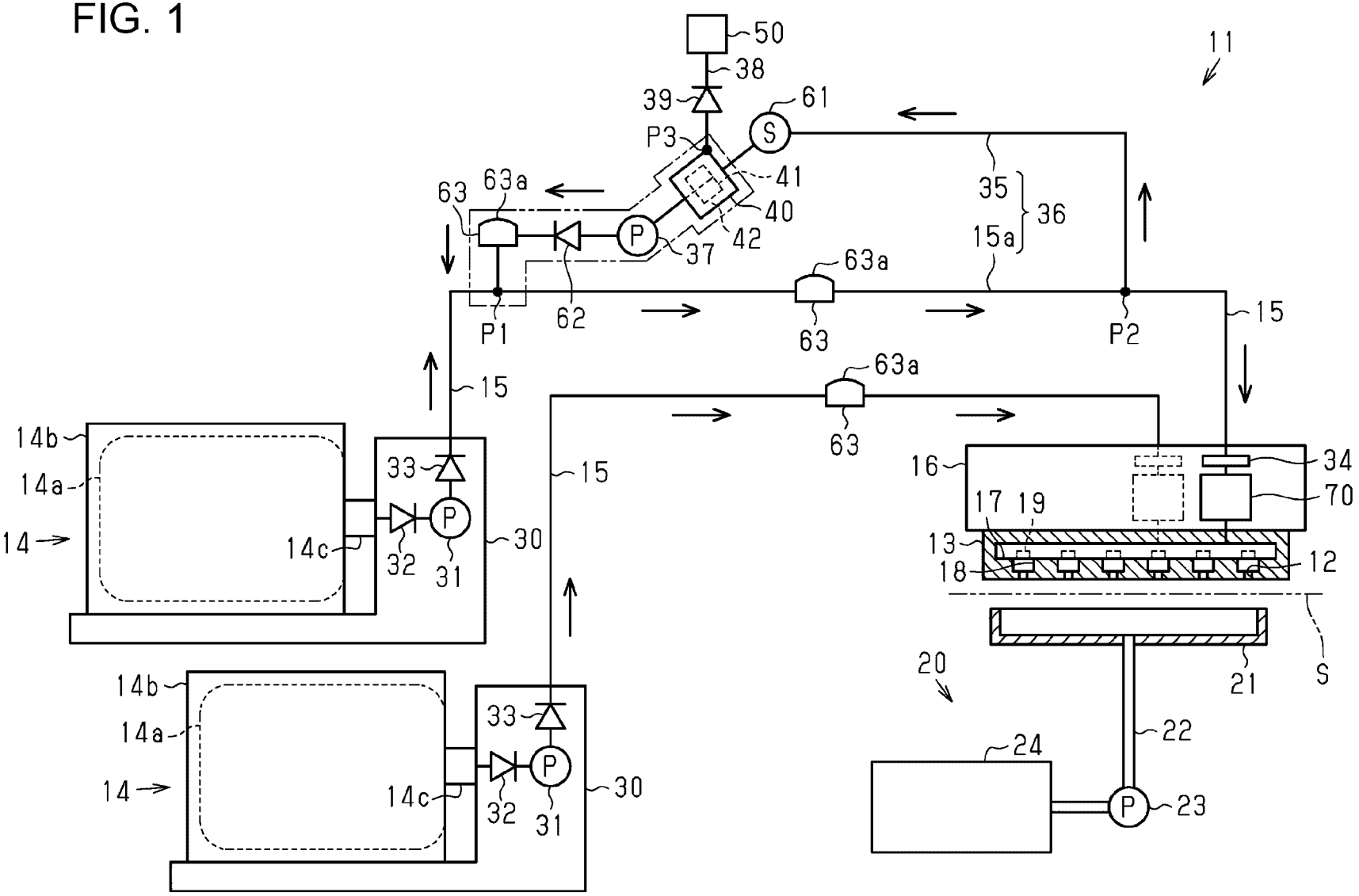
FIG. 1 is a diagram illustrating an overall configuration of a liquid ejecting apparatus according to an embodiment of the invention.

As illustrated in FIG. 1, a liquid ejecting apparatus 11 includes a liquid ejecting section 13, supply passages 15, and a maintenance device 20. The liquid ejecting section 13 discharges liquids onto a medium S through nozzles 12. Through the supply passages 15, the liquids are supplied from liquid supply sources 14 to the liquid ejecting section 13. The maintenance device 20 maintains the liquid ejecting section 13. In this liquid ejecting apparatus 11, the liquid supply sources 14 may be a plurality of liquid containers in which different types of liquids are stored. The numbers of nozzles 12 and the supply passages 15 may be each related to the number of liquids to be used. Further, a plurality of nozzles 12 may be provided for each liquid. It should be noted that a horizontal direction of the page of FIG. 1 may correspond to an actual vertical direction or a direction of a gravitational force, and the right side of the page of FIG. 1 may correspond to the bottom side in the actual vertical direction.

The liquid stored in at least one of the liquid supply sources 14 may be an ink containing a pigment that may settle out in a solution, such as water. An example of this ink is a white ink containing a white pigment. The liquid stored in another liquid supply source 14 may be an ink that contains no or a low content of pigment. Examples of this ink include a cyan, magenta, yellow, and other color inks.

For example, each liquid supply source 14 includes: a bag unit 14*a* that contains the liquid; a storage case 14*b* that accommodates the bag unit 14*a*; and an outlet 14*c* through which the liquid in the bag unit 14*a* flows out to the outside of the storage case 14*b*. In this case, the liquid ejecting apparatus 11 may include mounting units 30 to which the respective liquid supply sources 14 are detachably attached.

Each mounting unit 30 may include a supply pump 31 that applies pressure to the liquid in the corresponding liquid supply source 14 and supplies this liquid to the liquid ejecting section 13. As an example, the supply pump 31 may be a diaphragm pump. In this case, a one-way valve 32 has to be provided upstream of the supply pump 31, and a one-way valve 33 has to be provided downstream of the supply pump 31. As an alternative example, the supply pump 31 may be a tube pump or an air supply pump that supplies pressurized gas to the interior of the storage case 14*b* to compress the bag unit 14*a*, thereby supplying the liquid to the liquid ejecting section 13. If the supply pump 31 is a tube pump or an air supply pump, the above one-way valves 32 and 33 are unnecessary.

A liquid reservoir 63 may be provided in each supply passage 15 at its midway location. Each liquid reservoir 63 temporality stores the liquid, helping supply the liquid to the liquid ejecting section 13 at a constant pressure. The liquid reservoir 63 may be an open tank. More preferably, however, the liquid reservoir 63 may be a closed tank in which a portion of the surrounding wall is a deformable film 63*a*. Using a closed tank as the liquid reservoir 63 can reduce a risk of external gas being mixed in the liquid in the liquid reservoir 63.

The liquid ejecting section 13 includes: a common liquid chamber 17 in which the liquids supplied through the supply passages 15 are temporality stored; a plurality of cavities 18 provided in relation to the nozzles 12; and a plurality of actuators 19 provided in relation to the cavities 18. By driving the actuators 19, the liquids are discharged through the nozzles 12.

Pressure adjusting mechanisms 70 may be provided upstream of the common liquid chamber 17. Each pressure adjusting mechanism 70 helps supply the liquid to the liquid ejecting section 13 at a constant pressure. The common liquid chamber 17 may be provided with filters 34 on its upstream side, in order to purify the liquids. Each filter 34 has a capacity to capture foreign matter that may fail to pass through the liquid ejecting section 13.

The liquid ejecting apparatus 11 may include a retainer 16 that holds the liquid ejecting section 13. In this case, the retainer 16 may also hold the pressure adjusting mechanisms 70 and the filters 34. As an example, if the liquid ejecting section 13 employs a serial type, the retainer 16 may be a carriage that reciprocates across the medium S while holding the liquid ejecting section 13. As another example, if the liquid ejecting section 13 employs a line head type, the retainer 16 may be fixed to the route along which the medium S is fed.

The liquid ejecting apparatus 11 performs a maintenance operation in order to reduce the risk of failing to discharge the liquids. Such failures may be attributed to the clogging of the nozzles 12, the generation of bubbles in the liquid ejecting section 13, and the adhesion of foreign matter to the nozzles 12 or their surrounding area. Examples of the maintenance operation include flushing, capping, and suction cleaning. The flushing is performed to prevent an occurrence of a minor defect. More specifically, in the flushing, the liquids are discharged through the nozzles 12 in order to remove foreign matter, bubbles, or deteriorated liquid, such as sticky ink, that may cause a discharge failure.

The maintenance device 20 includes: a cap 21; a suction tube 22 with the upstream end connected to the cap 21; a suction pump 23 provided in the suction tube 22 at its midway location; and a waste liquid container 24 connected to the downstream end of the suction tube 22. The suction pump 23 may be a tube pump or other pump, for example.

The cap 21 is movable relative to the liquid ejecting section 13. More specifically, the cap 21 is movable relatively between a capping location at which the openings of the nozzles 12 are enclosed and a retracted location at which the openings of the nozzles 12 are exposed to the outside. The maintenance device 20 performs the capping by placing the cap 21 at the capping location. When the liquids are not discharged, the maintenance devices 20 performs the capping to suppress the nozzles 12 from being dried, thereby reducing the risk of the liquid ejecting apparatus 11 failing to discharge the liquids.

In the suction cleaning, the maintenance device 20 drives the suction pump 23 to apply negative pressure to the enclosed space created by the cap 21 placed at the capping location. Applying the negative pressure in this manner can suck fluid left in the nozzles 12 and remove the fluid therefrom. The liquid removed from the nozzles 12 by the suction cleaning is stored in the waste liquid container 24 as waste liquid. During the suction cleaning, the supply pumps 31 may be driven to supply pressurized liquid from the liquid supply sources 14 to the nozzles 12. With the suction cleaning, an old liquid that contains foreign matter, such as bubbles, is removed from the nozzles 12, and then fresh liquids are supplied from the liquid supply sources 14 to the supply passages 15 and the liquid ejecting section 13. As a result, the fresh liquids are filled in the supply passages 15 and the liquid ejecting section 13.

For example, if a liquid containing a sedimentary component, such as a white ink, flows through a supply passage 15, a return passage 35 may be connected to the supply passage 15. The return passage 35 has a first end and a second end that are opposite to each other. The first end is connected to the supply passage 15 at a first location P1, whereas the second end is connected to the supply passage 15 at a second location P2. The second location P2 is positioned closer to the liquid ejecting section 13 than the first location P1. In this embodiment, a portion of the supply passage 15 between the first location P1 and the second location P2 is referred to below as a middle passage 15*a*. This middle passage 15*a* and the return passage 35 constitute a circulating passage 36. The liquid reservoir 63 is preferably provided in the middle passage 15*a* of the supply passage 15 to which the return passage 35 is connected. In FIG. 1, the direction in which fluid flows through the supply passage 15 and the return passage 35 is denoted by the arrows.

A region in the supply passage 15 between the liquid supply source 14 and the first location P1 is referred to as an "upstream region". Both a region of the supply passage 15 between the second location P2 and the liquid ejecting section 13 and a region between the passages of the liquid ejecting section 13 and the nozzles 12 are collectively referred to as a "downstream region". In this case, the supply pump 31 is disposed in the upstream region, which is positioned closer to the liquid supply source 14 than the first location P1 of the supply passage 15, and supplies the liquid from the liquid supply source 14 to the liquid ejecting section 13.

The liquid ejecting apparatus 11 includes a circulating pump 37, a filter unit 40, a discharge passage 38, and an inflow controller 39. The circulating pump 37 causes fluid to flow through the circulating passage 36. The filter unit 40 is replaceable and is a portion of the return passage 35. The discharge passage 38 through which fluid is discharged to the outside is connected to the return passage 35. The inflow controller 39 can suppress external fluid from entering the discharge passage 38.

The circulating pump 37 may be a tube pump, for example. When rotating in one direction, the circulating pump 37 pushes the tube forming the passage to supply pressurized fluid. When rotating in the opposite direction, the circulating pump 37 releases the pushing of the tube to permit fluid to flow through the passage. Alternatively, the circulating pump 37 may be a diaphragm pump or other pump. When not performing a print operation, the liquid ejecting apparatus 11 drives the circulating pump 37 to circulate the liquid in the circulating passage 36. This causes the liquid to be stirred, reducing the risk of a pigment or other sedimentary component contained in the liquid settling out in the circulating passage 36.

For example, the inflow controller 39 may be a one-way valve that permits fluid to flow from the discharge passage 38 to the outside, but suppresses external air and gases from entering the discharge passage 38 and the fluid from flowing in the opposite direction, namely, from the discharge passage 38 to the filter unit 40. In addition, the discharge passage 38 may be provided with a gas-liquid separator 50 positioned downstream of the inflow controller 39. The gas-liquid separator 50 permits gas in the discharge passage 38 to be discharged to the outside but suppresses the liquid in the discharge passage 38 from being discharged. This gas-liquid separator 50 may be replaceable.

The filter unit 40 includes a filter 41 that captures foreign matter and an upstream filter chamber 42 in which the liquid that will pass through the filter 41 is stored on the primary side of the filter 41. The discharge passage 38 may be connected to the upstream filter chamber 42. Gas captured by the filter 41 stays in the upstream filter chamber 42. Thus, by connecting the discharge passage 38 to the upstream filter chamber 42, the gas captured by the filter 41 can be discharged from the upstream filter chamber 42 to the outside through the discharge passage 38.

In this embodiment, the filter 41 is referred to as an upstream filter, whereas the filter 34 that is disposed in the downstream region between the second location P2 of the supply passage 15 and liquid ejecting section 13 may be referred to as a downstream filter. The filter 34, which serves as the downstream filter, may have a lower capacity to capture foreign matter than the filter 41, which serves as the upstream filter.

For example, the circulating pump 37 may be disposed between the first end (first location P1) of the return passage 35 and a connecting location P3 at which the discharge passage 38 is connected to the return passage 35. The connecting location P3 is positioned between the first and second ends of the return passage 35. In this embodiment, a region in the return passage 35 between the connecting location P3 and the second location P2 is referred to as a "separated region", whereas a region in the return passage 35 between the connecting location P3 and the first location P1 is referred to as a "joint region". The joint region roughly corresponds to the region surrounded by the alternate long and two short dashes line in FIG. 1. Further, a pressure sensor 61 may be provided in the separated region. This pressure sensor 61 detects an inner pressure of the return passage 35, which is a portion of the circulating passage 36. A one-way valve 62 may be provided in the joint region between the circulating pump 37 and the first location P1. This one-way valve 62 permits fluid to flow from the circulating pump 37 to the first location P1 but suppresses the fluid from flowing in the opposite direction. The liquid reservoir 63 may be provided in the joint region between the one-way valve 62 and the first location P1.

Figure 2:
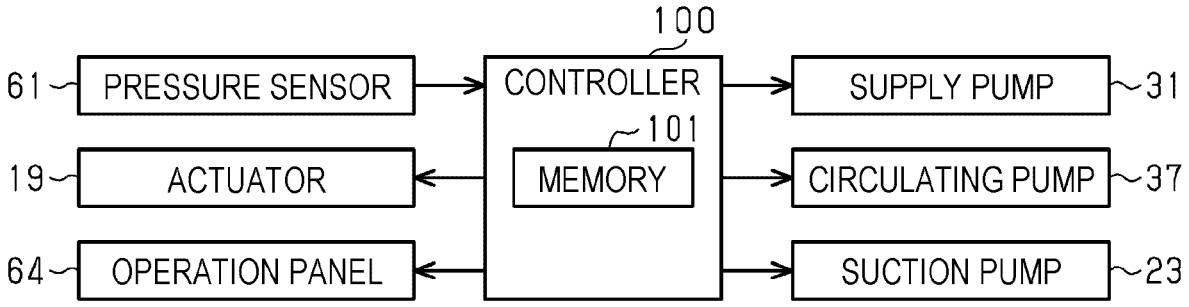
FIG. 2 is a block diagram illustrating an electrical configuration of the liquid ejecting apparatus in FIG. 1.

As illustrated in FIG. 2, the liquid ejecting apparatus 11 includes a controller 100 and an operation panel 64. The controller 100 controls the actuator 19, the supply pump 31, the circulating pump 37, the suction pump 23, and other constituent elements. The operation panel 64 displays operational states of these constituent elements and allows an instruction to be entered in the liquid ejecting apparatus 11. The controller 100 includes a memory 101 in which programs used to control the constituent elements are stored and performs various processes by executing the programs stored in the memory 101. The controller 100 is electrically connected to the pressure sensor 61.

The controller 100 estimates whether the filter 41 is clogged, at predetermined intervals. For example, when the circulating pump 37 is not driven, the controller 100 sets a pressure value detected by the pressure sensor 61 to a first pressure value. When the circulating pump 37 is driven, the controller 100 sets a pressure value detected by the pressure sensor 61 to a second pressure value. The controller 100 stores both the first and second pressure values in the memory 101. Then, if the difference between the first and second pressure values exceeds a preset threshold, the controller 100 estimates that the filter 41 is clogged so badly that it is necessary to replace the filter 41. In short, the controller 100 functions as an estimation section that estimates whether the filter 41 is clogged, on the basis of a driven state of the circulating pump 37 and pressure values detected by the pressure sensor 61.

The threshold used for this estimation may be determined in advance from some experiments and simulations and may be stored in the memory 101 of the controller 100. Alternatively, the threshold may be preset by a user through the operation panel 64 or other interface. When estimating that the filter 41 is clogged so badly that it is necessary to replace the filter 41, the controller 100 tells the user the estimation result through the operation panel 64 or other interface. This enables a clogged filter unit 40 to be replaced with a new filter unit 40 at an appropriate timing.

Figure 3:
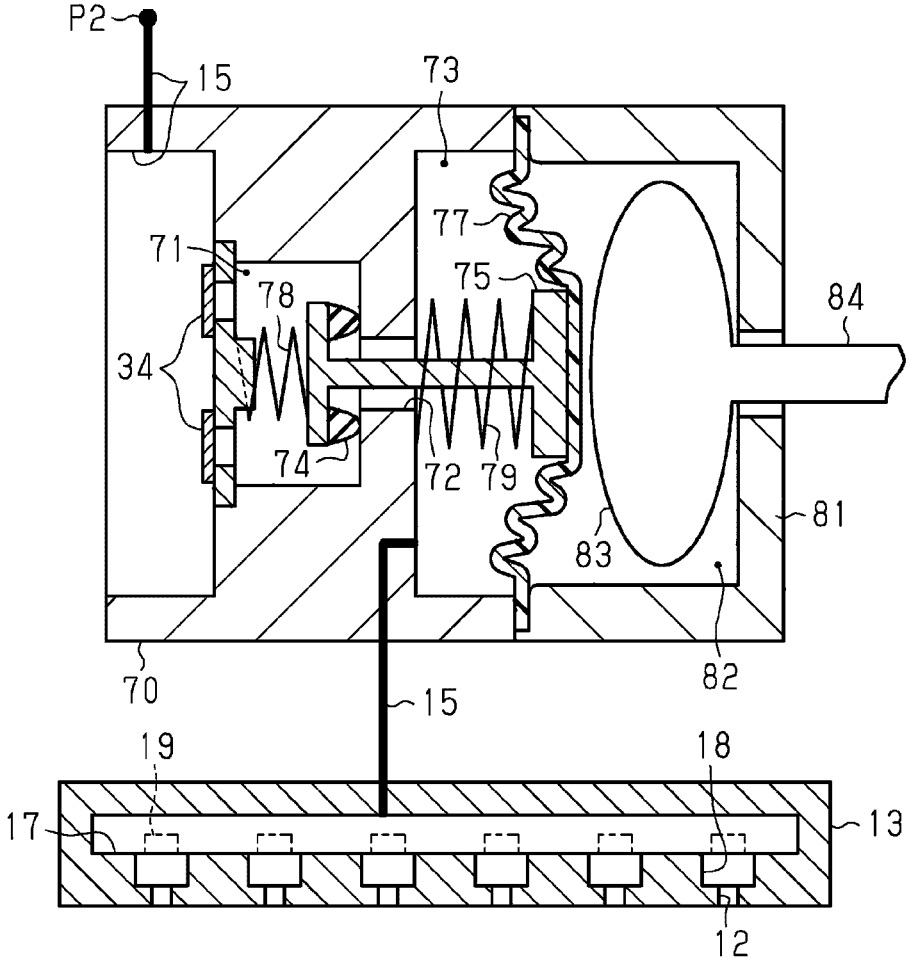
FIG. 3 is a cross-sectional view of a pressure adjusting mechanism provided in the liquid ejecting apparatus in FIG. 1.

Next, each pressure adjusting mechanism 70 according to the embodiment will be described. As illustrated in FIG. 3, each pressure adjusting mechanism 70 includes a supply chamber 71, a pressure chamber 73, a valving element 74, and a pressure receiving member 75. The supply chamber 71 is provided in the supply passage 15 at its midway location. The pressure chamber 73 communicates with the supply chamber 71 through a communicating hole 72. The valving element 74 opens or closes the communicating hole 72. The pressure receiving member 75 has a first end accommodated in the supply chamber 71 and a second end accommodated in the pressure chamber 73. The valving element 74 may be made from an elastic substance, for example, and covers the first end of the pressure receiving member 75 which is positioned inside the supply chamber 71. In addition, the filter 34 may be disposed at an inlet of the supply chamber 71, for example. The pressure receiving member 75 may include: a pressure receiving section at its first end which takes the shape of a thin plate; and a bar that is split into two parts while extending in the supply chamber 71. One of the split parts of the bar may be integrated with the valving element 74 in the supply chamber 71. It should be noted that a vertical direction of the page of FIG. 3 may correspond to an actual vertical direction or a direction of a gravitational force, and the bottom side of the page of FIG. 3 may correspond to the actual bottom side.

A portion of the wall surface of the pressure chamber 73 is a flexible film 77 that is displaceable. The pressure adjusting mechanism 70 includes a first biasing member 78 accommodated in the supply chamber 71 and a second biasing member 79 accommodated in the pressure chamber 73. The first biasing member 78 biases the valving element 74 through the pressure receiving member 75 in the direction in which the communicating hole 72 is closed.

The flexible film 77 creates distortion and is displaced in the direction in which the volume of the pressure chamber 73 decreases. By being pressed by this flexible film 77, the pressure receiving member 75 is displaced. More specifically, when the inner pressure of the pressure chamber 73 decreases in response to the discharge of the liquid through the nozzles 12, the flexible film 77 creates distortion and is displaced in the direction in which the volume of the pressure chamber 73 decreases. Then, when the pressure applied to the surface of the flexible film 77 on the pressure chamber 73 side is lower than the pressure applied to the other surface of the flexible film 77 and when the difference between these pressures is equal to or more than a preset value, such as 1 kPa, the pressure receiving member 75 is displaced. In response, the valving element 74 is switched from a closed valve state to an open valve state.

The above preset value is determined on the basis of: the biasing force of the first biasing member 78 and the second biasing member 79; a force required to displace the flexible film 77; a pressing force (sealing load) required for the valving element 74 to close the communicating hole 72; the inner pressure of the supply chamber 71 which is applied to the end of the pressure receiving member 75 on the supply chamber 71 side and the surface of the valving element 74; and the inner pressure of the pressure chamber 73. Thus, it can be found that the preset value increases as the total biasing force of the first biasing member 78 and the second biasing member 79 increases. Further, the biasing force of the first biasing member 78 and the second biasing member 79 may be set, for example such that the inner pressure of the pressure chamber 73 becomes negative, namely, such that the inner pressure of the pressure chamber 73 becomes −1 kPa when the atmospheric pressure is applied to the outer surface of the flexible film 77. Setting the total biasing force in this manner can form a meniscus at the air-liquid interface in the nozzles 12.

When the liquid flows from the supply chamber 71 to the pressure chamber 73 after the communicating hole 72 has been opened, the inner pressure of the pressure chamber 73 increases. Then, when the inner pressure of the pressure chamber 73 reaches the above preset value, the valving element 74 closes the communicating hole 72. As a result, even when the liquid is supplied to the supply chamber 71 at high pressure and then discharged to the outside through the nozzles 12, the inner pressure of the region containing the pressure chamber 73 and the cavities 18, namely, the back pressure of the nozzles 12 is maintained at approximately the preset value.

In this embodiment, the pressure adjusting mechanisms 70 are disposed in the downstream region containing the second location P2 of the supply passage 15 and the liquid ejecting section 13. Each pressure adjusting mechanism 70 is provided with the valving element 74 that switches the corresponding supply passage 15 between a communicating state and a non-communicating state. When the inner pressure of the region disposed downstream of the valving element 74 is lower than the preset value that is equal to or less than a pressure in an external space, the valving element 74 autonomously switches the corresponding supply passage 15 from the communicating state to the non-communicating state, namely, the communicating hole 72 from the open state to the closed state. In this case, each pressure adjusting mechanism 70 may serve as a differential pressure regulating valve, especially a pressure reducing valve.

Each pressure adjusting mechanism 70 may be provided with a valve opening mechanism 81 that forcedly opens the communicating hole 72 to supply the liquid to the liquid ejecting section 13. The valve opening mechanism 81 includes a pressure bag 83 and a pressure passage 84, for example. The pressure bag 83 is accommodated in a containing chamber 82 that is separated from the pressure chamber 73 by the flexible film 77. Through the pressure passage 84, gas flows into the pressure bag 83. When the gas flows into the pressure bag 83 through the pressure passage 84, the pressure bag 83 is expanded. The expanded pressure bag 83 causes the flexible film 77 to create distortion and be displaced in the direction in which the volume of the pressure chamber 73 decreases, thereby forcedly opening the communicating hole 72. In this way, the valve opening mechanism 81 forcedly opens the communicating hole 72, thereby forcedly switching the supply passage 15 from the non-communicating state to the communicating state, namely, switching the communicating hole 72 from the closed state to the open state.

Figure 4:
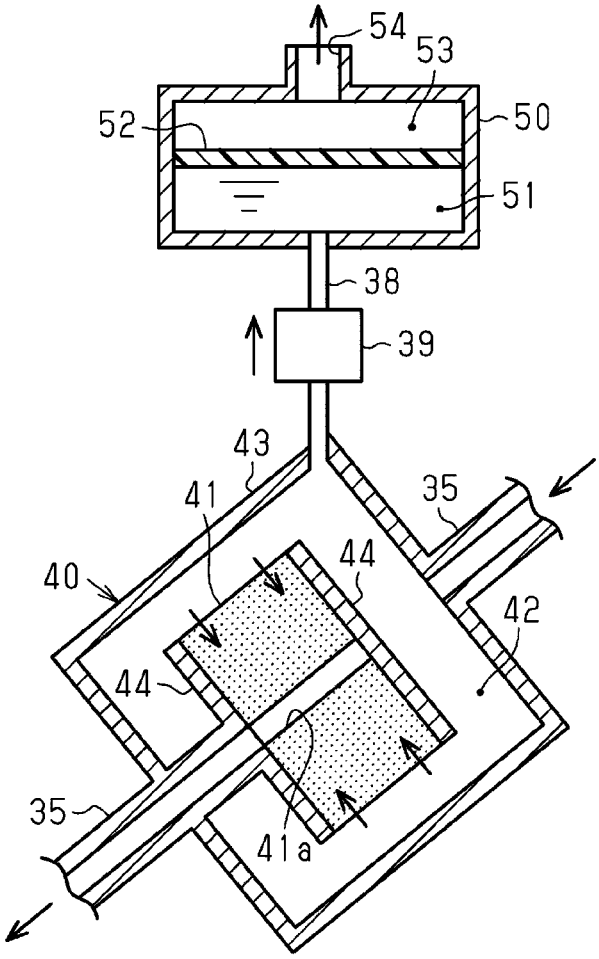
FIG. 4 is a cross-sectional view of the filter unit and the inflow controller provided in the liquid ejecting apparatus in FIG. 1.

Next, the filter unit 40 according to the embodiment will be described. As illustrated in FIG. 4, the filter unit 40 includes a case 43 that has a cylindrical shape. The filter 41 also has a cylindrical shape and is disposed inside the case 43 with both central axes aligned with each other. The return passage 35 is connected to the circular upper and bottom surfaces of the case 43. The upstream filter chamber 42 is a portion of the return passage 35 and is defined between the case 43 and the filter 41. It should be noted that a vertical direction of the page of FIG. 4 may correspond to an actual vertical direction or a direction of a gravitational force, and the bottom side of the page of FIG. 4 may correspond to the actual bottom side.

The filter 41 has a hole 41*a* formed between its upper and bottom surfaces to which respective support plates 44 each having a disc-like shape are attached. The upper portion of the hole 41*a* is closed by the support plate 44 disposed on the upper side, whereas the lower portion of the hole 41*a* passes through the support plate 44 disposed on the lower side. The inner space of the hole 41*a* is positioned on the secondary side of the filter 41 and corresponds to a portion of the joint region in the return passage 35.

The filter unit 40 is preferably disposed so as to be inclined with its primary or upstream side higher than its secondary or downstream side. In addition, the discharge passage 38 preferably communicates with the upstream filter chamber 42 at its upper portion. This configuration enables gases to enter the discharge passage 38 more easily than liquids. This is because when entering the upstream filter chamber 42, gas tends to stay in the highest portion of the upstream filter chamber 42, namely, at the highest corner.

When fluid enters the filter unit 40 from its upstream side, namely, from the separated region in the return passage 35, this fluid is temporally stored in the upstream filter chamber 42. Then, the fluid enters the filter 41 from its outer circumferential surface and reaches the hole 41*a*. As a result, foreign matter, such as bubbles, contained in the fluid is captured by the filter 41. The foreign matter captured by the filter 41 stays in the upper portion of the upstream filter chamber 42 and then flows out through the discharge passage 38 to the outside of the discharge passage 38. The liquid from which the foreign matter has been removed by the filter 41 passes through the hole 41*a* and then flows out to the downstream joint region in the filter unit 40. In FIG. 4, the flow direction of the fluid is denoted by the arrows.

Next, the gas-liquid separator 50 according to this embodiment will be described. As illustrated in FIG. 4, the gas-liquid separator 50 includes: a deaerating chamber 51 in which the liquid is temporarily stored at the end of the discharge passage 38; a discharge chamber 53 that is separated from the deaerating chamber 51 by a deaerating film 52; and a discharge path 54 through which the discharge chamber 53 communicates with the outside. The deaerating film 52 transmits gases but blocks liquids. An example of the deaerating film 52 may be formed by subjecting a resin material, such as polytetrafluoroethylene (PTFE), to special swaging and by forming therein many fine pores with a diameter approximately 0.2 μm. When liquid containing gas enters the deaerating chamber 51, only the gas passes through the deaerating film 52, then enters the discharge chamber 53, and discharged to the outside through the discharge path 54. With this configuration, the gas-liquid separator 50 reduces the discharge of liquid through the discharge passage 38 but permits the discharge of bubbles or dissolved gases contained in the liquid stored in the deaerating chamber 51.

Figure 5:
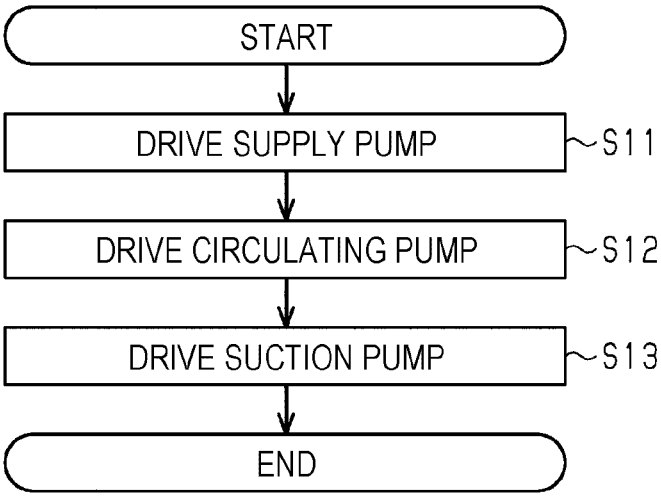
FIG. 5 is a flowchart of a process of discharging fluid from the liquid ejecting apparatus in FIG. 1.

Next, a description will be given of a method of discharging fluid from the liquid ejecting apparatus 11. Before a print operation, the liquid ejecting apparatus 11 performs an initial filling process. In this initial filling process, gas that has been left in the region between the supply passages 15 connected to the liquid supply sources 14 and the nozzles 12 is discharged to the outside, and then the liquid is filled in this region. The controller 100 performs the initial filling process that will be described below with reference to FIG. 5, as a method of discharging fluid.

At Step S11, the controller 100 performs a discharging step by driving the supply pump 31 over a predetermined period. The liquid in the liquid supply source 14 thereby flows into the supply passage 15. In response, fluid, usually gas, left in the supply passage 15 between the liquid supply source 14 and the second location P2, or in both the upstream region and the middle passage 15*a*, are discharged to the outside through the discharge passage 38. Likewise, fluid, usually gas, left in the return passage 35 between the second location P2 and the connecting location P3, or in the separated region, are discharged to the outside through the discharge passage 38. Then, the liquid is filled in the upstream region of the supply passage 15, the middle passage 15*a*, and the separated region of the return passage 35. However, some gas is still left in the joint region of the return passage 35 and the downstream region of the supply passage 15.

Before the discharging step, the controller 100 may perform the suction cleaning and fill the liquid in the supply passage 15 and the liquid ejecting section 13. Instead of performing the suction cleaning, alternatively, the controller 100 may drive the supply pump 31 and the valve opening mechanism 81, thereby filling the liquid in the supply passage 15 and the liquid ejecting section 13.

After the discharging step, at Step S12, the controller 100 performs a moving step by driving the circulating pump 37 over a predetermined period. In response, fluid, usually gas, left in the return passage 35 between the connecting location P3 and the first location P1, or in the joint region of the return passage 35 surrounded by the alternate long and two short dashes line in FIG. 1, are moved to the supply passage 15. Then, the liquid is moved from the separated region of the return passage 35 to the joint region and is filled in the entire return passage 35. In this case, the gas that has moved from the joint region of the return passage 35 is left in the supply passage 15 and the region positioned downstream of the supply passage 15 which contains the liquid ejecting section 13.

In the moving step, the liquid that has been filled in the middle passage 15*a* is moved to the separated region of the return passage 35. This means that the middle passage 15*a* preferably has a larger interior volume than the joint region of the return passage 35. Before the discharging step, the liquid may be filled in the entire supply passage 15 so that gas in the supply passage 15 is less likely to enter the return passage 35 during the moving step.

After the moving step, at Step S13, the controller 100 performs a filling step by performing suction cleaning in which the suction pump 23 is driven over a predetermined period while the nozzles 12 are covered with the cap 21. Gas that has been moved from the return passage 35 to the supply passage 15 and left in the downstream region of the supply passage 15 is thereby discharged to the outside through the nozzles 12 in the liquid ejecting section 13. In this filling step, the supply pump 31 may be driven together with the suction pump 23. Alternatively, at the filling step, the supply pump 31 and the valve opening mechanism 81 may be driven, instead of the suction pump 23, to supply the liquid to the supply passage 15 and the liquid ejecting section 13 at high pressure. With the filling step, the liquid is filled in the entire supply passage 15, return passage 35, and liquid ejecting section 13. In this way, the initial filling process has been completed.

The process of filling the liquid in the passages may be performed before the liquid ejecting apparatus 11 performs a print operation or after the filter unit 40 has been replaced. When the process of filling the liquid is performed after the filter unit 40 has been replaced, the discharging step in the initial filling process may be skipped. In other words, only the moving step and the filling step may be performed. If the gas-liquid separator is replaceable, the gas-liquid separator 50 may be replaced together with the filter unit 40 before the liquid is filled in the passages.

When the high-pressure liquid enters from the upstream filter chamber 42 to the deaerating chamber 51 through the discharge passage 38, for example during the print operation, the liquid may leak out from the deaerating film 52. If there is a risk that the liquid leaks out, the gas-liquid separator 50 may be detached from the liquid ejecting apparatus 11 after the initial filling process has been completed. In addition, a new gas-liquid separator 50 may be attached to the liquid ejecting apparatus 11 before the filter unit 40 is replaced and the liquid is filled in the passages.

Next, a description will be given of functions of the liquid ejecting apparatus 11 configured above. At the discharging step of the initial filling process, the supply pump 31 is driven. In response, gas left in the upstream region of the supply passage 15, the middle passage 15*a*, and the separated region of the return passage 35 enters the upstream filter chamber 42. After entering the upstream filter chamber 42, the gas stays in an upper portion of the upstream filter chamber 42. Most of the gas enters the deaerating chamber 51 in the gas-liquid separator 50 without passing through the filter 41 and then passes through the deaerating film 52. After having passed through the deaerating film 52, the gas is discharged to the outside through the discharge chamber 53 and the discharge path 54.

Even when both liquid and gas enter the deaerating chamber 51 at the discharging step, only the liquid is blocked from passing through the deaerating film 52. Thus, the liquid stays in the deaerating chamber 51. In this way, the gas is discharged from the upstream filter chamber 42, and as a result, the upstream filter chamber 42 is filled with the liquid.

When the circulating pump 37 is driven at the moving step, the liquid left in the separated region of the return passage 35 is sucked and flows into the upstream filter chamber 42. After having flown into the upstream filter chamber 42, the liquid is still sucked by the circulating pump 37, then passes through the filter 41, and enters the hole 41*a* on the secondary side of the filter 41. In this case, some gas is left in the joint region disposed downstream of the filter 41, but the gas is blocked from flowing out from the discharge passage 38. Therefore, the liquid enters the supply passage 15 at the first location P1. After the gas having entered in the supply passage 15, the joint region of the return passage 35 is filled with the liquid supplied through the middle passage 15*a*, which is a portion of the circulating passage 36.

Since the one-way valve 62 is provided to suppress the liquid from flowing through the return passage 35 in the opposite direction, the driving of the suction pump 23 may fail to fill the liquid in the return passage 35. Even in this case, the liquid is filled in the return passage 35 by the discharging and moving steps. In the discharging step, the liquid pushes gas, which then enters the upstream filter chamber 42, and the gas is preferentially purged from the upstream filter chamber 42 at its upper portion. In this case, the amount of liquid discharged is lower than that discharged together with the gas by the suction cleaning.

At the filling step, gas left in the supply passage 15 is discharged to the outside through the nozzles 12 by the driving of the suction pump 23. In this case, liquid discharged together with the gas is left in a region of the middle passage 15*a* that the gas has not entered from the return passage 35. Specifically, the amount of liquid discharged substantially corresponds to the difference in interior volume between the middle passage 15*a* and the joint region of the return passage 35. In the initial filling process, thus, only a small amount of liquid is consumed in relation to the discharge of gas.

After the initial filling process, the liquid circulates in the circulating passage 36, for example at intervals between the print operations. In this case, the liquid is stirred, and foreign matter contained in the liquid is captured by the filter 41 in the return passage 35. As a result, the liquid from which the foreign matter has been removed is returned to the middle passage 15*a* and then is supplied to the liquid ejecting section 13. Furthermore, gas captured by the filter 41 or staying in the upper portion of the upstream filter chamber 42 due to its buoyancy is discharged to the outside through the upper portion of the upstream filter chamber 42. In this way, the gas is removed from the middle passage 15*a*, which is a portion of the circulating passage 36.

The foregoing embodiment can produce the following effects.

(1) The liquid ejecting apparatus 11 is provided with the filters 41 and 34 in the supply passage 15. Providing the filters 41 and 34 in this manner can suppress foreign matter, such as bubbles, from entering the liquid ejecting section 13 through the nozzles 12. This reduces the risk of the liquid ejecting apparatus 11 failing to replaceable together with the filter unit 40. Therefore, even when the filter 41 and 34 in which foreign matter is accumulated on its primary side prohibits the supply of the liquid, the filter 41 can be replaced, so the flow of the liquid is improved.

(2) The above filter unit 40 is disposed in the return passage 35. Providing the filter unit 40 in this manner enables the liquid to reliably flow through the supply passage 15 even if the filter 41 is clogged. In short, although the filter 41 is provided in a passage connected to the liquid ejecting section 13, this filter 40 does not prohibit the liquid from being supplied appropriately.

(3) Each of the above filters 34 may have a lower capacity to capture foreign matter than the above filter 41. As described above, the filter unit 40 is replaceable. Therefore, most foreign matter in passages is captured by the filter 41 in the filter unit 40 and removed by the replacement of the filter 41. This makes it possible to suppress the filter 34 from being clogged. During a print operation in which the liquid does not circulate in the circulating passage 36, for example, foreign matter contained in the liquid to be supplied to the liquid ejecting section 13 is captured by the filter 34.

(4) The liquid ejecting apparatus 11 is provided with the discharge passage 38 through which the liquid containing gas is discharged to the outside. Providing the discharge passage 38 in this manner enables gas in the supply passage 15 to be discharged to the outside. In addition, gas captured by the filter 41 can be discharged to the outside through the discharge passage 38.

(5) The liquid ejecting apparatus 11 is provided with the inflow controller 39 in the discharge passage 38. Providing the inflow controller 39 in this manner can suppress external gas from entering the discharge passage 38 and fluid from flowing through the discharge passage 38 in the opposite direction, namely, from the discharge passage 38 to the filter unit 40.

(6) The liquid ejecting apparatus 11 is provided with the gas-liquid separator 50 in the discharge passage 38. Providing the gas-liquid separator 50 in this manner can suppress the liquid from being discharged to the outside through the discharge passage 38 when liquid containing gas enters the discharge passage 38. Thus, only a small amount of liquid is discharged to the outside together with gas.

(7) The liquid ejecting apparatus 11 is provided with the pressure sensor 61 in the return passage 35. Providing the pressure sensor 61 in this manner can detect an increase in a pressure loss which may be attributed to the clogging of the filter 41. Furthermore, the controller 100 serves as the estimation section that estimates a timing at which the filter 41 is replaced. This makes it possible to replace the filter unit 40 at an appropriate timing.

The foregoing embodiment may be modified as in modifications that will be described below. It should be noted that the configuration of the foregoing embodiment may be combined with the configurations of the modifications as appropriate. Alternatively, the configurations of the modifications may be combined with one another as appropriate. In the following description, the identical reference numerals are given to constituent elements that have the same functions as those in the foregoing embodiment, and these constituent elements will not be described.

Figure 6:
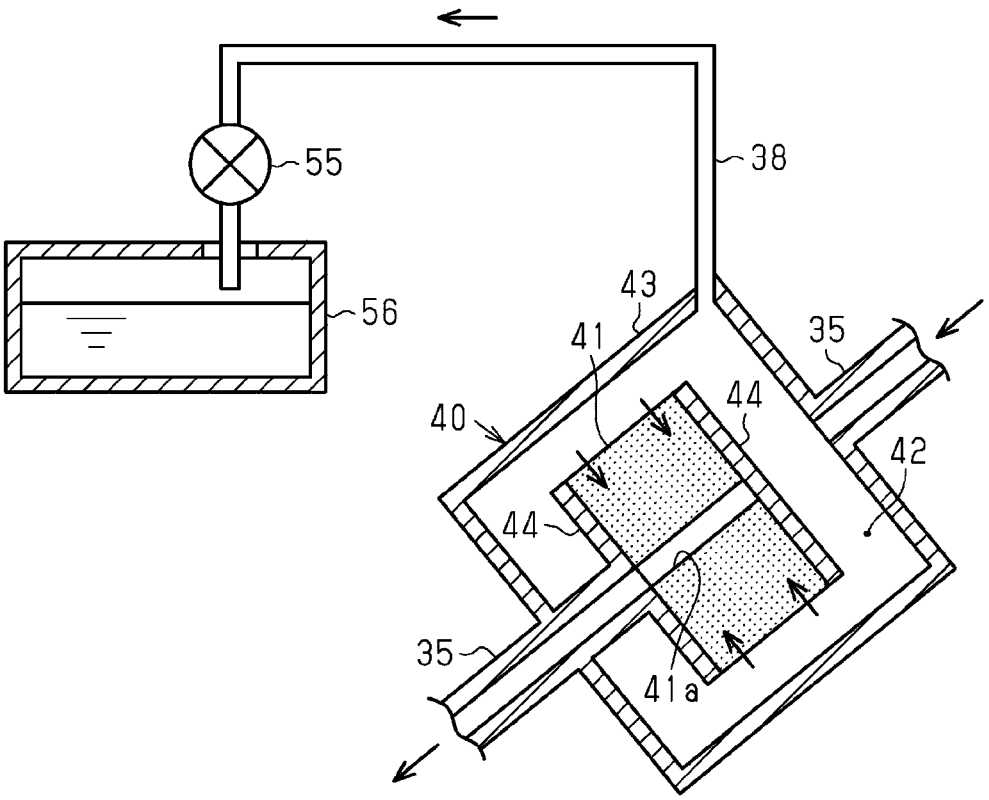
FIG. 6 is a cross-sectional view of a modification of the configuration in FIG. 4.

As in the modification illustrated in FIG. 6, instead of the above gas-liquid separator 50, a changeover valve 55 may be provided in a discharge passage 38 on its downstream side, an upstream end of which is connected to an upstream filter chamber 42 in a filter unit 40. The changeover valve 55 switches the discharge passage 38 between a communicating state and a non-communicating state as appropriate. This configuration does not require a one-way valve, such as the inflow controller 39, in the discharge passage 38. Furthermore, a waste liquid receptor 56 may be provided. When the changeover valve 55 sets the discharge passage 38 to the communicating state, fluid (mixed fluid of liquid and air) to be discharged to the outside through the discharge passage 38 may be stored in the waste liquid receptor 56. In this case, the waste liquid container 24 (see FIG. 1) may double as the waste liquid receptor 56. In the configuration of FIG. 6, the flow direction of the fluid is denoted by the arrows. It should be noted that a horizontal direction of the page of FIG. 6 may correspond to an actual vertical direction or a direction of a gravitational force, and the bottom side of the page of FIG. 6 may correspond to the bottom side in the actual vertical direction.

An initial filling process using the changeover valve 55 provided in the discharge passage 38 may be performed in the following manner. First, a discharging step may be performed with the discharge passage 38 set to the communicating state. Then, the moving step and the filling step may be performed with the discharge passage 38 set to the non-communicating state. In addition, the print operation may be performed with the discharge passage 38 set to the non-communicating state.

More specifically, the initial filling process may be performed in the following manner. First, at the discharging step, the discharge passage 38 is set to the communicating state, and a supply pump 31 and a valve opening mechanism 81 are driven. As a result, the liquid is filled in the separated region of a supply passage 15 and a return passage 35, and a liquid ejecting section 13. At the moving step, then, the discharge passage 38 is set to the non-communicating state, and a circulating pump 37 is driven. Instead of performing the filling step, the discharge passage 38 is set to the communicating state again, and the supply pump 31 is driven. As a result, fluid (mixed fluid of liquid and gas) that has been moved from the joint region of the return passage 35 to the supply passage 15 flows to the separated region of the return passage 35 and discharged to the outside through the discharge passage 38.

If the changeover valve 55 is provided in the discharge passage 38, when the filter unit 40 is replaced, the discharge passage 38 may be switched from the non-communicating state to the communicating state. By setting the discharge passage 38 to the communicating state, the inner pressure of the discharge passage 38 is returned to the atmospheric pressure. This can suppress the liquid in the discharge passage 38 from leaking out during the replacement of the filter unit 40.

If the changeover valve 55 is provided in the discharge passage 38, before the controller 100 estimates whether the filter 41 is clogged, the discharge passage 38 may be switched from the non-communicating state to the communicating state, and the circulating pump 37 may be driven. As a result, bubbles accumulated in the upstream filter chamber 42 are discharged to the outside through the discharge passage 38. This can reduce the influence of bubbles on the clogging of the filter 41, thereby helping the controller 100 accurately estimate whether the filter 41 is clogged by solids, not by bubbles.

The circulating pump 37 may be disposed in the separated region between a connecting location P3 of the return passage 35 and a second location P2. The circulating pump 37 may also be disposed in the separated region between a pressure sensor 61 in the return passage 35 and the second location P2. In these cases, when a pressure detected by the pressure sensor 61 exceeds a preset threshold during the driving of the circulating pump 37, the controller 100 can estimate that the filter 41 is clogged so badly that it is necessary to replace the filter 41.

The circulating pump 37 may be removed from the return passage 35, and the supply pump 31 may be used as a pump that causes the liquid to flow into the circulating passage 36. If the pressure adjusting mechanism 70 is present, even when the supply pump 31 is driven to increase an inner pressure of the supply passage 15 disposed upstream of the supply chamber 71, the liquid is not supplied to the liquid ejecting section 13 unless the inner pressure of the pressure chamber 73 becomes a preset negative value. Thus, when the supply pump 31 is driven while the pressure adjusting mechanism 70 is adjusting the pressure of the liquid supplied to the liquid ejecting section 13, the liquid in the middle passage 15*a* does not flow to the downstream region in the supply passage 15 but enters the return passage 35 at the second location P2. As a result, the liquid circulates in the circulating passage 36.

The circulating pump 37 may be driven depending on whether the filter 41 is clogged. If the filter 41 is clogged so badly that it is necessary to replace the filter 41, for example, the circulating pump 37 may be driven such that a rate at which the fluid flows through the circulating passage 36 becomes lower than that when the filter 41 is not clogged. This can reduce an increase in an inner pressure of the circulating passage 36.

The circulating pump 37 may be driven in an intermittent manner so that the fluid flows through the circulating passage 36 in pulse form. As an example, when the liquid is stirred in the circulating passage 36 in order to suppress a pigment contained in the liquid from settling out therein, the circulating pump 37 may be driven in an intermittent manner so that the fluid flows through the circulating passage 36 in pulse form. As another example, when gas is discharged from the circulating passage 36 in the initial filling process, the circulating pump 37 may be driven in a continuous manner.

The circulating pump 37 may be driven such that a rate at which the fluid flows through the circulating passage 36 when the fluid is stirred is different from that when gas is discharged from the circulating passage 36 as in the initial filling process. For example, the flow rate may be set to a larger value when the gas is discharged from the circulating passage 36 than when the fluid is stirred.

When the supply pump 31 and the valve opening mechanism 81 are driven to discharge fluid from the supply passage 15 through the nozzles 12, the circulating pump 37 may also be driven to increase the inner pressure of the supply passage 15.

In this embodiment and modifications, examples of the medium S include a paper sheet, a plastic film, a plate sheet, and a cloth to be used by a textile apparatus. Examples of liquids ejected from the liquid ejecting section 13 include inks and liquid substance in which particles of a functional material are dispersed or mixed in a liquid. For example, such a liquid substance may be formed by dispersing or dissolving, in the liquid, an electrode material, a color material, or a pixel material, which are to be used to manufacture liquid crystal displays, electroluminescent (EL) displays, or surface emitting diodes.

Technical ideas that can be derived from the foregoing embodiment and modifications and their functions and effects will be described below.

[Idea 1]

A liquid ejecting apparatus comprising:

a liquid ejecting section from which liquid is ejected;

a supply passage through which the liquid is supplied from a liquid supply source to the liquid ejecting section;

a return passage having a first end and a second end, the first end being connected to the supply passage at a first location, the second end being connected to the supply passage at a second location, the second location being positioned closer to the liquid ejecting section than the first location, the return passage and the supply passage constituting a circulating passage;

a pump that can cause fluid to flow through the circulating passage;

a filter unit having a filter that captures foreign matter, the filter unit being replaceable, the filter unit being a portion of the return passage;

a discharge passage through which the fluid is discharged to an outside of the liquid ejecting apparatus, the discharge passage being connected to the return passage; and an inflow controller that can suppress external fluid from entering the discharge passage.

According to Idea 1, the inflow controller suppresses gas from flowing into the discharge passage. Thus, by discharging liquid containing gas in passages to the outside through the discharge passage, the gas can be removed from the passages. In the filter unit, which is a portion of the return passage, gas captured by the filter is discharged to the outside through the discharge passage. By replacing this filter unit, clogging of the filter can be eliminated. Providing the filter unit in the return passage enables the liquid to reliably flow through the supply passage even when the filter is clogged. Although provided with a filter in a passage connected to the liquid ejecting section, this configuration can appropriately supply liquid to the liquid ejecting section.

[Idea 2]

The liquid ejecting apparatus according to Idea 1, wherein the pump is a circulating pump disposed between the first end and a connecting location at which the return passage is connected to the discharge passage.

According to Idea 2, fluid in the return passage at the connecting location is caused to flow into the supply passage by driving of the circulating pump. In response, fluid flows from the second end of the return passage to the connecting location, and fluid flows from the supply passage into the return passage. Circulating fluid in the circulating passage in this manner makes it possible to capture foreign matter contained in the fluid by using the filter and to discharge gas contained in the supply passage and the return passage to the outside through the discharge passage. Furthermore, by providing the circulating pump in addition to the supply pump that supplies liquid from the liquid supply source, foreign matter can be captured or gas can be discharged by driving of the circulating pump when the liquid is not supplied to the liquid ejecting section.

[Idea 3]

The liquid ejecting apparatus according to Idea 1 or 2, further comprising:

a pressure adjusting mechanism disposed in a downstream region between the second location of the supply passage and the liquid ejecting section, the pressure adjusting mechanism having a valving element that can switch the supply passage between a communicating state and a non-communicating state, wherein when an inner pressure of a region disposed downstream of the valving element becomes less than a preset value that is less than a pressure of an external space, the valving element switches the supply passage from the communicating state to the non-communicating state; and a supply pump that can supply the liquid from the liquid supply source to the liquid ejecting section, the supply pump being disposed in an upstream region, the upstream region being positioned closer to the liquid supply source than the first location of the supply passage.

According to Idea 3, the pressure adjusting mechanism is provided to adjust a pressure of liquid supplied to the liquid ejecting section. In which case, the supply pump is used to cause the liquid to flow through the circulating passage.

[Idea 4]

The liquid ejecting apparatus according to one of Ideas 1 to 3, wherein the inflow controller is a one-way valve that permits the fluid in the discharge passage to flow out to the outside.

According to Idea 4, gas is suppressed from flowing into the discharge passage, but fluid (mixed fluid of liquid and gas) in passages is permitted to be discharged to the outside through the discharge passage. In this way, the gas is removed from the interiors of the passages.

[Idea 5]

The liquid ejecting apparatus according to one of Ideas 1 and 4, wherein the filter unit has an upstream filter chamber on its primary side, the liquid being stored in the upstream filter chamber before passing through the filter, and the discharge passage is connected to the upstream filter chamber.

According to Idea 5, gas captured by the filter stays in the upstream filter chamber, and is discharged to the outside through the discharge passage connected to the upstream filter chamber.

[Idea 6]

The liquid ejecting apparatus according to one of Ideas 1 to 5, further comprising a gas-liquid separator that permits gas to be discharged through the discharge passage but suppresses the liquid from being discharged through the discharge passage.

According to Idea 6, when gas (mixed fluid of liquid and gas) enters the discharge passage, the gas-liquid separator suppresses the liquid from being discharged to the outside through the discharge passage. Thus, only a small amount of liquid is discharged to the outside together with gas.

[Idea 7]

The liquid ejecting apparatus according to one of Ideas 1 to 6, wherein the filter is an upstream filter, the liquid ejecting apparatus further comprises a downstream filter disposed in a downstream region between the second location of the supply passage and the liquid ejecting section, and the downstream filter can capture foreign matter that may fail to pass through the liquid ejecting section and has a lower capacity to capture the foreign matter than the upstream filter.

According to Idea 7, when liquid does not circulate in the circulating passage, foreign matter contained in the liquid to be supplied to the liquid ejecting section is captured by the downstream filter.

[Idea 8]

The liquid ejecting apparatus according to one of Ideas 1 to 7, wherein the pump is a circulating pump provided in the return passage, and the liquid ejecting apparatus further comprising:

a pressure sensor that can detect an inner pressure of the circulating passage; and an estimation section that estimates whether the filter is clogged, on the basis of a driven state of the circulating pump and a pressure detected by the pressure sensor.

According to Idea 8, the estimation section estimates a timing at which the filter is replaced, thus making it possible to replace the filter unit at an appropriate timing.

[Idea 9]

The liquid ejecting apparatus according to Idea 8, wherein the pressure detected by the pressure sensor when the circulating pump is not driven is a first pressure value, the pressure detected by the pressure sensor when the circulating pump is driven is a second pressure value, and when a difference between the first pressure value and the second pressure value exceeds a preset threshold, the estimation section estimates that the filter is clogged so badly that it is necessary to replace the filter.

According to Idea 9, the estimation section detects an increase in a pressure loss on the basis of the difference between the first and second pressure values. When the pressure loss increases to exceed the preset threshold, the estimation section estimates that the filter is clogged. This makes it possible to appropriately estimate a timing at which the filter is replaced.

[Idea 10]

A method of discharging fluid from liquid ejecting apparatus, the liquid ejecting apparatus including a liquid ejecting section from which liquid is ejected, a supply passage through which the liquid is supplied from a liquid supply source to the liquid ejecting section, a return passage having a first end and a second end, the first end being connected to the supply passage at a first location, the second end being connected to the supply passage at a second location, the second location being positioned closer to the liquid ejecting section than the first location, the return passage and the supply passage constituting a circulating passage, and a discharge passage through which the fluid is discharged to an outside of the liquid ejecting apparatus, the discharge passage being connected to a connection location of the return passage between the first end and the second end, the method comprising:

causing the liquid in the liquid supply source to flow out to the supply passage to discharge, through the discharge passage, fluid left in the supply passage between the liquid supply source and the second location and fluid left in the return passage between the second location and the connecting location;

then, causing fluid left between the connecting location of the return passage and the first location to flow to the supply passage; and discharging the fluid that has flown to the supply passage through the liquid ejecting section.

According to Idea 10, before liquid is filled in the supply passage and the return passage in which gas is left, the gas in the supply passage between the liquid supply source and the second location and in the return passage between the second location and the connecting location is discharged to the outside through the discharge passage. Then, the gas left in the return passage between the connecting location and the first location is moved to the supply passage, and discharged to the outside through the liquid ejecting section. Thus, only a small amount of liquid is discharged to the outside together with gas before the liquid is filled in the supply passage and the return passage.

The entire disclosure of Japanese Patent Application No. 2016-196542, filed Oct. 4, 2016 is expressly incorporated by reference herein.

What is claimed is:

1. A method of discharging fluid from a liquid ejecting apparatus, the liquid ejecting apparatus including a liquid ejecting portion from which liquid is ejected, a supply passage through which the liquid is supplied from a liquid supply source to the liquid ejecting portion, a return passage having a first end and a second end, the first end being connected to the supply passage at a first location, the second end being connected to the supply passage at a second location, the second location being positioned closer to the liquid ejecting portion than the first location, the return passage and the supply passage constituting a circulating passage, and a discharge passage through which the fluid is discharged to an outside, the discharge passage being connected to a connection location of the return passage between the first end and the second end, the method comprising:

performing a discharging operation of discharging fluid through the discharge passage by causing the liquid in the liquid supply source to flow out to the supply passage, the fluid being fluid in the supply passage between the liquid supply source and the second location and fluid in the return passage between the second location and the connecting location;

performing a moving operation of causing fluid between the connecting location of the return passage and the first location to flow to the supply passage after the discharging operation is performed; and performing a filling operation of discharging the fluid flowed to the supply passage in the moving operation through the liquid ejecting portion.

2. The method according to claim 1, the liquid ejecting apparatus further including a supply pump configured to supply the liquid from the liquid supply source to the liquid ejecting section, the supply pump being disposed in an upstream region, the upstream region being positioned closer to the liquid supply source than the first location of the supply passage, wherein the outflow of the liquid in the liquid supply source to the supply passage in the discharging operation is performed by driving the supply pump.

3. The method according to claim 2, wherein the filling operation is performed by driving the supply pump.

4. The method according to claim 1, the liquid ejecting apparatus further including a circulating pump configured to circulate fluid in the circulating passage, the circulating pump being provided in the return passage, wherein the moving operation is performed by driving the circulating pump.

5. The method according to claim 1, wherein the discharging operation is performed in a state in which a gas-liquid separator that allows passage of gas and restricts passage of the liquid is coupled to a discharge port of the discharge passage.

6. The method according to claim 1, the liquid ejecting apparatus further including a cap configured to enclose a space where a nozzle through which the liquid ejecting portion ejects the liquid opens, wherein the filling operation is performed by applying a negative pressure to the enclosed space.

7. The method according to claim 1, the liquid ejecting apparatus further including a switching valve configured to switch between a communicating state in which the discharge passage communicates with the outside and a non-communicating state in which the discharge passage does not communicate with the outside, wherein the discharging operation is performed in the communicating state, and the moving operation and the filling operation are performed in the non-communicating state.

* * * * *